US007347754B1

(12) United States Patent
Cheung

(10) Patent No.: US 7,347,754 B1
(45) Date of Patent: Mar. 25, 2008

(54) FLEXIBLE ENCAPSULATED SPRING STRINGER FOR BODYBOARD

(75) Inventor: Wah Kan Cheung, Thornhill (CA)

(73) Assignee: Bamba International (Canada) Ltd, Thornhill, Ontario (CA)

( * ) Notice: Subject to any disclaimer, the term of this patent is extended or adjusted under 35 U.S.C. 154(b) by 0 days.

(21) Appl. No.: 11/702,244

(22) Filed: Feb. 3, 2007

(51) Int. Cl.
*B63B 1/00* (2006.01)

(52) U.S. Cl. ..... 441/65; 441/74

(58) Field of Classification Search ..... 441/65, 441/74, 79; 114/65 R, 357
See application file for complete search history.

(56) References Cited

U.S. PATENT DOCUMENTS 3,414,919 A * 12/1968 Gust ..... 441/74
4,995,843 A * 2/1991 Englemann ..... 441/74
5,816,875 A * 10/1998 Bixby ..... 441/74
6,036,560 A * 3/2000 Pekar ..... 441/65
6,305,305 B1 * 10/2001 Johnson ..... 441/74

* cited by examiner

*Primary Examiner*—Lars A. Olson
(74) *Attorney, Agent, or Firm*—Clement Cheng

(57) ABSTRACT

A variable flexible bodyboard comprises a lightweight, generally elongated, foam core material having a top skin layer and a bottom skin layer with a front nose end and a rear tail end. The bodyboard has also an elongated stringer element having a one end and an other end, and composed of at least one stiffener material, of a defined length, to impart stiffness to the bodyboard, and at least one flexible material, of a defined length, to impart flexibility to the bodyboard. The stringer element is positioned and secured within the foam core material of the bodyboard; and a helical spring is disposed within the stringer element imparting additional resiliency to the stringer element.

25 Claims, 3 Drawing Sheets

FLEXIBLE ENCAPSULATED SPRING STRINGER FOR BODYBOARD

BACKGROUND

A. Field of the Invention

The present invention relates generally to bodyboards and stiffening elements thereof.

B. Discussion of Related Art

Sports boards composed of a preformed, preshaped, generally planar foam core with a slick bottom skin are very popular for use on water, snow, grass, ice or other surfaces. One type of sports board comprises a bodyboard or surf board and is employed in the water, more particularly for wave surfing. Generally, bodyboards are made of semi-rigid foam core, typically with polystyrene foam, polyethylene foam or polypropylene foam, and have polyethylene foam sheets laminated to the top and side surfaces of the foam core, and have a bottom surface composed of a polymeric film material, to provide a low-frictional slick surface for gliding purpose.

During wave riding, a user may bend the board and turn on the water. The board typically restores to neutral position after bending. The recovery of original shape is always referred as the 'memory' of the foam core. Polypropylene foam core has better memory characteristics than other foam core materials. Therefore, polypropylene foam core is typically used for high end performance bodyboards due to its resilient, rigid and light weight physical properties.

Typically, bodyboards are ridden in a prone position, with one arm extending forwardly for gripping the nose and the other arm positioned in a trailing manner for gripping the front portion of the side edge of the bodyboard. With the arms and hands thus positioned, the rider can push or pull against the engaged front or side edges to bend or twist the board to increase friction and drag on selected parts of the board, which help the rider in redirecting the board. The force applied to the bodyboard that only distorts the board does not help the rider. Thus, a high degree of stiffness of the bodyboard is desirable. However, it may not be desirable to make the bodyboard very rigid entirely from the nose to the tail. For example, it may be desirable for the board to be more flexible at the portion between a transverse line about a quarter of the way from the nose and the lead nose. Such flexibility allows the rider to pull up the nose of board and steer the board to the desirable direction in wave surfing. It is therefore desirable to provide an improved bodyboard with stiffening element(s) adapted to provide the resistance to flex on the major supporting region of the board and yet allow adequate flexibility along a longitudinal axis of the foam core in the forward quarter of the board.

A variety of stringers and stiffening methods have been described in the prior art. U.S. Pat. No. 6,036,560 issued to Pekar on Mar. 14, 2000, filed Feb. 5, 1999, the disclosure of which is incorporated herein by reference, shows a flexible stringer rod that imparts flexibility to the front nose area of a bodyboard. The flexible front nose area provides greater maneuverability for the bodyboard. The Pekar patent shows an elongated stringer element comprising a stiff portion of fiberglass or graphite resin-impregnated material and a flexible portion of a front tip end of a polyethylene material, and generally longitudinally arranged within the foam core material and extending substantially from the tail end toward the front end.

The disadvantage of using a solid plastic rod such as polyethylene in the front portion of stringer is that the recoil of the polyethylene rod is very slow and the stringer does not return to the original straight shape spontaneously. Changing the stiffness of the bodyboard is also accomplished by external means. As an example for comparison, U.S. Pat. No. 5,224,890 invented by Moran issued on Jul. 6, 1993, the disclosure of which is incorporated herein by reference, shows a fiber mesh stiffener for selected regions of differing stiffness in order to combine in one board the speed associated with relatively stiff bodyboards and the maneuverability of soft bodyboards. Laminated into the layered structure of the bodyboard is a fiber mesh. The fiber mesh is an example of an external stiffening method. It is obviously more desirable to obtain an improved bodyboard with a variable flexible stringer that responses instantaneously with the bending force applied by rider.

One conventional method of strengthening bodyboard is to insert one or more cylindrical rods, know as stringers, into holes drilled parallel to the longitudinal axis of the board from the tail end toward the nose end. A stringer system would generally include a fiberglass or graphite rod that is centrally inserted and adhesively secured in the foam core material. The disadvantage of the current stringer systems used is that the stringer may separate from the foam core after frequent use, in extreme conditions of use, for example when the board is bent up harshly, the stringer rod can pop out of either the deck or the bottom of the bodyboard. It would be desirable to provide an improved stringer element composed of two sections, rear section composed of a material to impart stiffness to the bodyboard, while the front or tip section of the stringer element composed of a flexible material to permit flexing of the nose and front portion of the bodyboard by a rider.

Thus, it is one object of the invention to provide a polyolefin foam sports board with improved handling and customizable stiffness.

SUMMARY OF THE INVENTION

Figure 1:
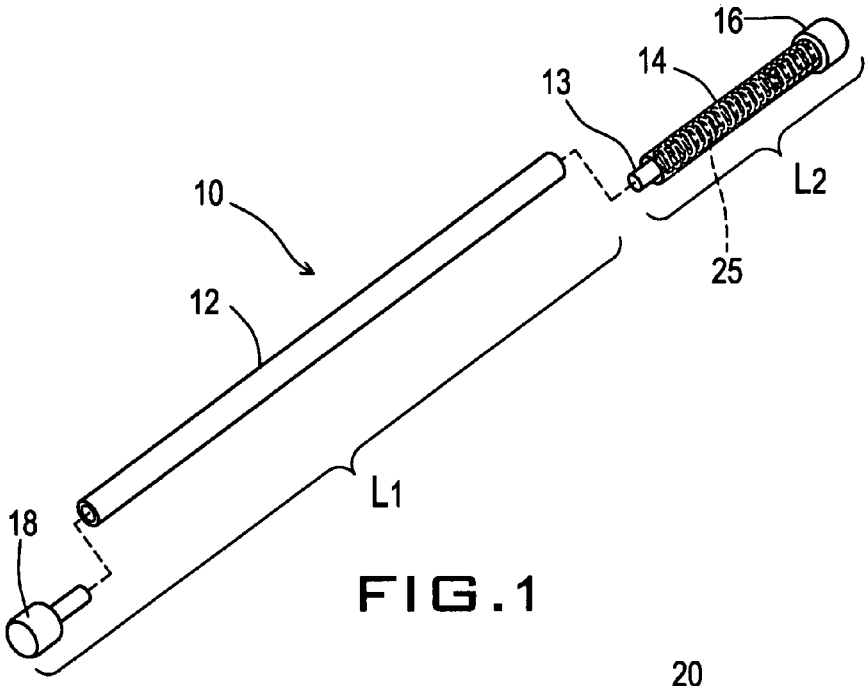
FIG. 1 is a perspective view of a stringer element of the invention.

The invention relates to a variable flexible bodyboard and method. In particular it concerns a bodyboard with a variable flexible, typically, a two-part stringer element and to the stringer element itself. This invention is an improvement on prior art U.S. Pat. No. 6,036,560 issued to Pekar on Mar. 14, 2000, filed Feb. 5, 1999. The present invention applies an encapsulated coil or helical spring instead of a solid plastic rod used by the prior art as the flexible element in the front portion of the stringer in a bodyboard. The helical spring significantly improves the elasticity of the flexible element and instantaneous shape recovery of a bodyboard after the released of bending force applied by a rider to the front portion of the board.

The invention is directed to a sports board which comprises a preformed, preshaped board, typically but not limited to a bodyboard, which comprises a generally planar foam board, having a top and bottom surfaces, a nose end, a rear tail end and two opposing side rail surfaces extending from one to the other end of the board. Generally the board is planar in nature, and comprises a closed-cell thermoplastic foam core consisting of polystyrene, polyethylene or polypropylene foam material, a low-frictional thermoplastic polymer film material laminated to the bottom surface of the board and the upper and lower rail surfaces and the top surface are covered by a frictional close-cell foam material.

A helical spring is defined as a spring in the shape of a helix or coil and includes coil springs whether or not the helical spring receives compression or tensile loading. The invention includes a helical or coil spring that provides greater elasticity to the stringer element. The coil spring is preferably located in the portion of the stringer that requires greater flexibility.

The invention, similar to Pekar, comprises a variable flexible bodyboard which comprises a lightweight, generally elongated, foam core material having a top skin layer and a bottom skin layer, with a front nose end and a rear tail end. An elongated stringer element having one end and an other end, and generally longitudinally arranged within the foam core material and extending substantially from the tail end toward the front end. The stringer element may vary in flexibility along the length, from the one end to the other end, a substantial first length portion of the stringer end extending at the one end and from the tail end of the foam core material, toward the nose end and adapted to increase the stiffness of the foam core material; and a second length portion toward the nose end of the foam core material, having greater flexibility than the first portion, and adapted to increase flexibility of the nose end of the bodyboard by a rider.

The invention comprises a fiber reinforced resin portion and an encapsulated helical spring portion. The helical spring portion is typically situated in the front portion of a bodyboard and consists of a helical spring encapsulated inside a plastic tube, which provides a housing to contain the helical spring, allowing larger contact area with the foam core and optionally providing a mean of securing the helical spring to the fiber reinforced resin portion. The variable flexible encapsulated spring stringer is typically a cylindrical rod which has a selected length and is adapted to be inserted into a foam core material of a bodyboard or flotation device to impart selective stiffness to the main body riding portions of the bodyboard and selected flexibility to the front and nose portion of the bodyboard for rider control purposes. The incorporation of a helical spring in the front portion of stringer provides variable flexibility in the front portion of a bodyboard and allows quick recovery to its original shape after bending. Upon bending the spring element, the center spring of the helical spring assembly is thereby in a stress or spring condition with mechanical energy to tend to return to the original straight shape. The spring configuration of the present invention has a much higher mechanical energy compared with a solid plastic rod in response to bending. Another advantage of the present spring stringer design is that the helical spring portion of the stringer has wider flexibility in designing the desirable stiffness and elasticity for specific requirement of a performance bodyboard than a solid plastic rod.

The instantaneous shape recovery is important to the performance and maneuverability of soft bodyboards in response to the bending force applied by a rider to the front portion of a bodyboard. When a bending force is applied to bend the front portion of the stringer, the bodyboard will flex and allow steering of bodyboard to the desirable direction. After the release of bending force, the stringer can instantaneously return to its original straight position and allow the bodyboard resuming the original rocker shape for planning motion, allowing maximum surfing speed and projection. Such a system would permit the production of high quality bodyboards and other amusement devices with variable flexibility in selected portion of the board and the board recover to its original shape or response quickly after the release of bending force applied by a rider to the portion.

The resilience or elasticity of the helical spring portion depends on the physical properties and configuration of the helical spring. The length, elastic modulus, and stiffness of the helical spring element may be varied to provide the desirable stiffness and elasticity properties for required bodyboard performance. The stiffness and flexibility of the helical spring can be adjusted by one of the following parameters: material, cross-sectional shape and area, pitch, and coil diameter of the spring wire. It is recognized that stiffness and flexibility may be imparted along the length of the helical spring element employing the same material, but varying coil diameter of spring wire progressively from one end to the other end. For example, the coil diameter can be largest at the end connecting to the fiber reinforced resin portion and progressively decrease towards the nose of the board. The progressive reduction in coil diameter would allow progressive decrease in stiffness towards the nose. Two or more sections of helical spring may be jointed together along the length, each section of spring element may have different characteristics such as cross-sectional shape, cross-sectional area, material; or combinations thereof. For example, the spring element may contain two sections, a stiff section with larger spring wire diameter and a front flexible section with smaller spring wire diameter, which allows greater flexibility in the nose of the board. It is recognized and part of the invention that spring elements further comprise a plurality of spring element sections along the length of the helical spring section, may be employed to impart multiple lengthwise regions of selected, e.g., progressive increased flexibility. Such a spring element may, for example, have three connected spring sections such as a stiff region, a region of greater flexibility, and an end region of even greater flexibility.

The improved stringer elements of the invention include at least one spring element in each system, but may include the use of a plurality of spring elements; for example, two, three or more of the same or selected length, as required, to obtain the desirable stiffness and resilience properties on the selected length of the stinger. The helical spring element may also be composed of two or more helical springs of the same or selected length interlaced with each other and these springs may have different characteristics of material, cross-sectional shape and area, pitch, and coil diameter and may be connected together in a few intersecting locations. The compound helical spring construction provides increase stiffness and elasticity in the selected length of the bodyboard.

Here, in one embodiment, the stringer element comprises a solid rod or tube of up to 22 to 32 inches or about 50 to 90% in length of a resin-impregnated fiber material for stiffness and about 3 to 14 inches or 10 to 50% in length of a flexible encapsulated helical spring. The stringer elements of the invention may be inserted or placed in the foam core material of the bodyboard in numerous ways including: laminating the foam core material or sheets with the stringer elements molded in place; or for example, holes drilled or formed within the foam core material, usually from the tail end, and the stringer elements snugly inserted into the holes; and optionally, adhesively secured in position, the hole ends sealed, and then the top skin and bottom skin layer laminated over the hole closures.

The invention provides for at least one elongated stringer element, such as an elongated rod along a majority of its length. The stringer element will permit greater flexibility toward its tip or front end and may be selected to have the same or similar flex properties as the surrounding foam core material. Therefore, the bodyboard with the flexible spring stringer system overcomes the prior art problem of tearing through the bodyboard and provides selected stiffness to the main riding portions of the bodyboard and selected flexibility to the front portion. Furthermore the present invention overcomes the deficiency of slow recovery from the flex in the prior art.

In one embodiment, the bodyboard comprises a low density, e.g., 1.6 to 6 lb/ft$^3$, closed cell polyethylene, semi rigid foam core material of typically, about 2 inches in thickness, a length of about 36 to 42 inches and width of about 19 to 24 inches.

The stringer rod comprises a stiff portion of fiberglass or graphite resin-impregnated material and a flexible portion of a front tip end of a helical spring extending from about 3 to 14 inches from the tip end of the stringer rod element with a preferable diameter of about 0.5 to 1.2 inch. The stiff portion of the stringer rod provides stiffness to the bodyboard, while the flexible portion provides flexibility of the front nose area of the bodyboard. Optionally, rounded plastic plugs or caps may be used at each end of the stringer rod to reduce sharp edges. The stringer rod is generally longitudinally arranged within the foam core material and extending substantially from the tail end toward the front end. Usually, the stringer rod or rods are inserted into a hole drilled from the tail end of the foam core material prior to lamination or application of the top and bottom skin layers and adhesively secured in the hole.

The stiff portion may comprise a polymer, fiber reinforced thermoplastic polymer, wound or woven fibers, resin-impregnated fibers, wood or other material. Prior art materials now used, such as thermoset resin-impregnated glass fiber and graphite fiber rods may also be employed. Useful thermoset resin suitable for the application includes epoxy, vinyl ester, polyester and urethane. The plastic tube of the helical spring portion may be made of common thermoplastic polymers comprising polyethylene, polypropylene, urethane and vinyl chloride polymers. The helical spring element is typically a commercial spring steel. A large selection of steel and alloy metal including high carbon steel, cold rolled spring steel, alloy spring steel, stainless steel, Copper base alloy and Nickel base alloy may be employed to form the spring to obtain the desirable stiffness, elasticity and other required physical properties. Optionally spring made of polymeric material may also be used if desirable.

The improved stringer elements of the invention include at least one stringer element in each system, but may include the use of a plurality of stringer elements; for example, two, three, four, or more of the same or selected length, as required, to obtain a bodyboard or other flotation board device of selected performance properties. For example, the bodyboard may include multiple, elongated, spaced-apart, generally parallel stringer elements in the bodyboard. The stringer elements may vary in diameter, shape, and length as used.

The bodyboard may be composed of any floatation-type foam material to include, but not limited to, substantially semi-rigid, substantially closed cell (or open cell when sealed) polymeric foam material, such as polystyrene, olefin polymers of polyethylene; polypropylene; and copolymers containing styrene, ethylene or propylene; urethane foams, and vinyl foam of vinyl polymers like polyvinyl chloride and other vinyl esters.

The bodyboard has a laminated top skin layer, may have appropriate decorative designs, as well as areas to prevent the movement of the rider's body in use, and a smooth, slick, laminate bottom skin layer. The invention shall be described for the purposes of illustration only in connection with certain illustrated embodiments. It is recognized that various modifications, additions, improvements, and changes may be made by persons skilled in the art without departing from spirit and scope of the invention as disclosed and claimed.

DETAILED DESCRIPTION OF THE PREFERRED EMBODIMENT

FIG. 1 shows the stringer element rod 10 of the invention composed of a solid, 16 mm diameter rod composed of a first portion length (L1) of about 22 to 32 inches in length, preferable 26 inches of a thermoset resin impregnated glass fiber or graphite fiber material 12, with a second portion (L2) of about 3 to 14 inches in length, preferable 6.5 inches of a steel helical spring material 14. The rod 10 includes plastic end plugs 16 and 18 snapped on the rod ends. The plastic plugs can be made of any polymer material and is preferable made of polyethylene. The helical spring 14 is encapsulated by a plastic tube 25 of outside diameter 16 mm which additionally includes a joining section 13 that has interference with fiberglass tube 12. The inside diameter of the plastic tube 25 has a range of about 8 mm to 26 mm and preferably 14 mm. The spring 14 is a helical spring that has an outside diameter of preferably slightly less than 14 mm allow it to fit inside the plastic tube 25. The spring 14 may be made of any commercial spring steel in desirable coil spring configuration. Preferably the helical spring is about 6 inches in length, about 14 mm in coil diameter and has a rectangular cross-sectional shape of size about 3 mm width by 2 mm thick and a pitch of about 6 mm.

Figure 2:
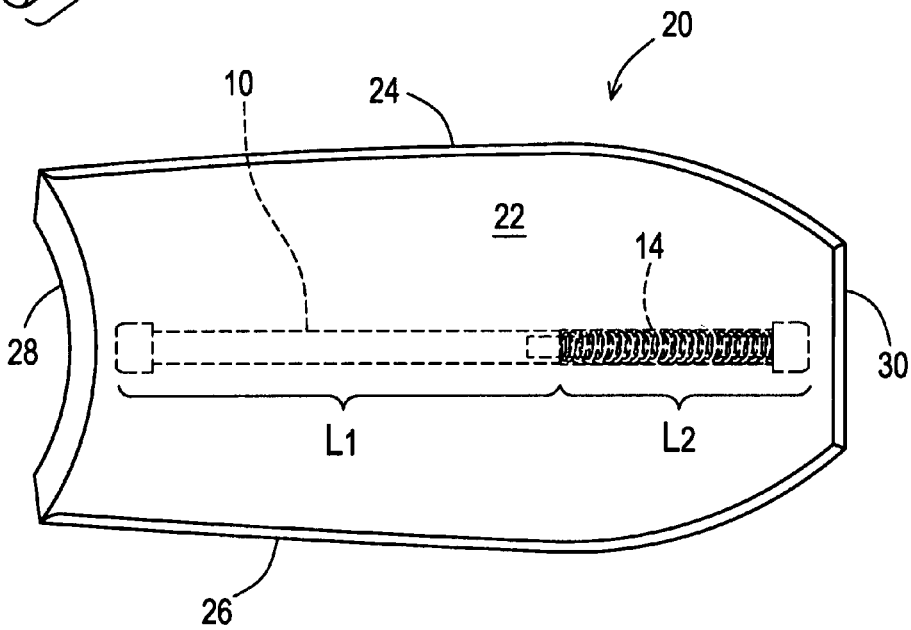
FIG. 2 is a top plan view of a bodyboard of the invention with the stringer element of FIG. 1 illustrated in dotted lines.
Figure 3:
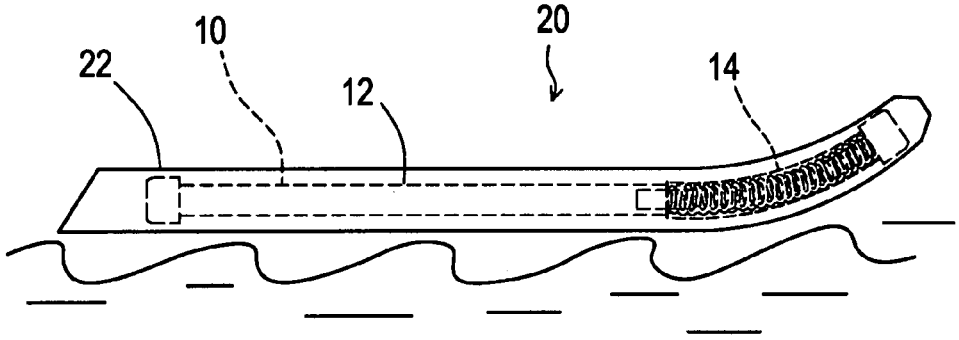
FIG. 3 is a side plan view of the bodyboard of FIG. 2 with the nose in a flexed position.

FIGS. 2 and 3 show a bodyboard 20 composed of a polyethylene foam core material and having a top skin layer 22, inclined side edges 24 and 26, a contoured tapered tail end 28, and a first nose chine 30. The bodyboard 20 has a centrally dispersed stringer rod element 10 within the foam core material, with the flexible portion 14 extending into the front nose area of the bodyboard 20. FIG. 3 illustrates the upward flex of the bodyboard 20 in use with the stringer rod element 10.

Figure 4:
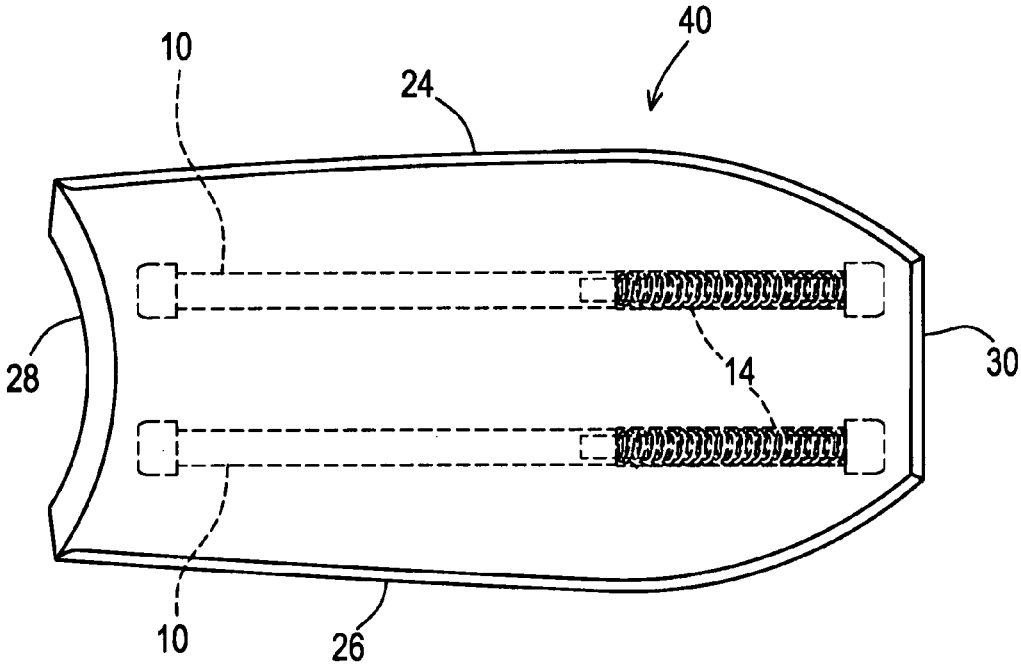
FIG. 4 is a top plan view of another embodiment of the bodyboard with a pair of stringer elements of FIG. 1.

FIG. 4 is a top plan view of a bodyboard 40 with a pair of spaced-apart parallel stringer rod elements 10 secured in the foam core material.

Figure 5:
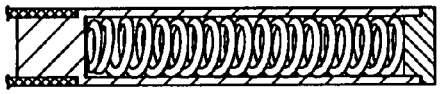
FIG. 5 shows a longitudinal cross-sectional view of the first embodiment of the stringer rod.
Figure 6:
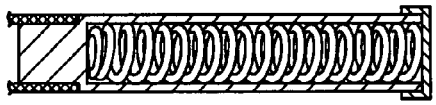
FIG. 6 shows a longitudinal cross-sectional view of the first embodiment of the stringer rod.

FIG. 5 and FIG. 6 show a longitudinal cross-sectional view of the first embodiment of the stringer rod 10. The stringer rod 10 comprises a helical spring section and a fiberglass tube section. In the helical spring section, a helical spring 14 is situated inside a polyethylene tube 25. The opening of the polyethylene tube 25 is closed by a polyethylene end plug 16. The polyethylene tube provides a housing to contain the helical spring and to provide a uniform and larger contact area with the foam core. Thereby the helical spring is enclosed by the polyethylene tube and the encapsulated spring is connected to the fiberglass tube through the joining section 13 of the polyethylene tube. The polyethylene tube may be made by machining a solid polyethylene rod or by plastic injection molding or other conventional plastic fabrication methods. One end of the helical spring may be embedded inside the joining section 13.

An open coil spring has been found to be the most desirable configuration compared with other configurations such as a flat spring. A coil spring provides increased length of spring material for a given length of front portion of the stringer. Therefore a coil spring has better stiffness and springs back faster than a flat spring. A coil spring structure also contains a lot of empty space that help to counter balance the overall weight of the stringer.

Figure 7:
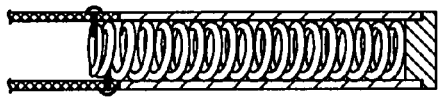
FIG. 7 shows a longitudinal cross-sectional view of the second embodiment of the stringer rod.
Figure 8:
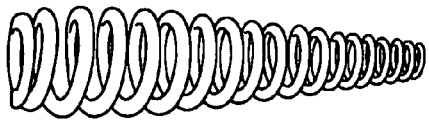
FIG. 8 shows an example of a possible coil configuration in helical spring design.
Figure 9:
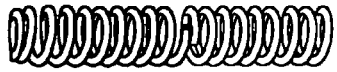
FIG. 9 shows an example of a possible coil configuration in helical spring design.
Figure 10:
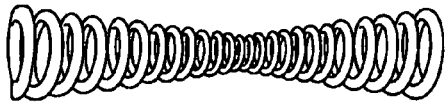
FIG. 10 shows an example of a possible coil configuration in helical spring design.
Figure 11:
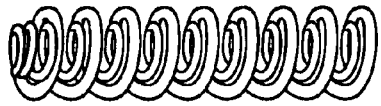
FIG. 11 shows an example of a possible coil configuration in helical spring design.

FIG. 7 shows a longitudinal cross-sectional view of the second embodiment of the stringer rod 10. One end of the helical spring is fastened to the fiberglass tube in one or a few places. Fasteners such as bolts or screws can be used. Optionally, a polymer material such as thermosetting resin may be applied to fill up the internal hollow space of the fiberglass tube and secure the helical spring end to the fiberglass tube.

FIG. 8-FIG. 11 shows various examples of possible coil configurations in the design of the helical spring. A variety of configurations are shown including: a spring that gets smaller toward the tip; a spring that ends and is connected to another spring; a spring that starts large and narrows in the middle to become large again; and finally a spring nestled within coils of another spring. Thus, the spring need not necessarily be a spring of constant shape and cross section.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims.

The invention claimed is:

1. A variable flexible bodyboard comprising:

a. a lightweight, generally elongated, foam core material having a top skin layer and a bottom skin layer, with a front nose end and a rear tail end;

b. an elongated stringer element having a one end and an other end, and generally longitudinally arranged within the foam core material and extending substantially from the tail end toward the front end; the stringer element varying in flexibility along the length from the one end to the other end, a substantial first length portion of the stringer extending at the one end from the tail end of the foam core material toward the nose end and adapted to increase the stiffness of the foam core material; and a second length portion toward the nose end of the foam core material, having greater flexibility than the first portion, and adapted to increase flexibility of the nose end of the bodyboard by a rider; and c. a helical spring disposed within the second length.

2. The bodyboard of claim 1, wherein the stringer element comprises a rod element generally centrally positioned in the bodyboard.

3. The bodyboard of claim 1, wherein the foam core material comprises a polyolefin foam material, and the material of the second length portion comprises polyethylene.

4. The bodyboard of claim 1, wherein the stringer element comprises at least a pair of rod elements spaced-apart and generally parallel in the bodyboard.

5. The bodyboard of claim 1, wherein the stringer element comprises a first length material of a glass fiber resin or graphite material, and the second length material comprises a polyethylene material.

6. The bodyboard of claim 1, wherein the stringer element include an end cap on the one end and the other end.

7. The bodyboard of claim 1, wherein the stringer element has a second length portion of about 3 to 14 inches.

8. The bodyboard of claim 1, wherein the stringer element comprises a solid cylindrical rod or tube.

9. The bodyboard of claim 1, wherein the second length portion comprises about 10 to 50 percent in length of the stringer element.

10. A stringer element adapted for insertion and use in the foam core material of a bodyboard, which stringer element comprises:

a. an elongated rod element having a one end and an other end and a selected length and composed of a first length portion which comprises a majority of the length of the rod element; and b. a second length portion which comprises, at the one end of the rod element, a polymeric material to support flexibility to a nose section of the bodyboard; and c. a helical spring disposed within the second length portion imparting additional resiliency to the second length portion.

11. The stringer element of claim 10, wherein the helical spring is comprised of two or more sections joined together, each section of spring element having a different cross-section.

12. The bodyboard of claim 10, wherein the helical spring is comprised of two or more sections joined together, each section of spring element made of a different material.

13. The bodyboard of claim 10, wherein the helical spring is comprised of two sections joined together, a stiff section with a greater spring wire cross section and a front flexible section with smaller spring wire cross section disposed toward the front nose end, whereby allowing greater flexibility in the front nose end.

14. The stringer element of claim 10, wherein the fiber-resin material comprises a glass fiber or graphite resin impregnated material.

15. The stringer element of claim 10, which includes end caps on the one and other end.

16. A variable flexible bodyboard which comprises:

a. a lightweight, generally elongated, foam core material having a top skin layer and a bottom skin layer with a front nose end and a rear tail end;

b. an elongated stringer element having a one end and an other end, and composed of at least one stiffener material, of a defined length, to impart stiffness to the bodyboard, and at least one flexible material, of a defined length, to impart flexibility to the bodyboard, the stringer element positioned and secured within the foam core material of the bodyboard; and c. a helical spring disposed within the stringer element imparting additional resiliency to the stringer element.

17. The bodyboard of claim 16, which includes a stringer element with the flexible material at the one or other end and the stiffener material between the one and other ends.

18. The bodyboard of claim 16, wherein the stringer element includes a plurality of flexible material lengths and a plurality of stiffener material lengths.

19. The bodyboard of claim 16, wherein the stringer element comprises a solid olefin polymer at the one or other end of the stringer element, and the foam core material comprises a foam polyolefin core material.

20. The bodyboard of claim 16, wherein the stringer element has a glass or graphite fiber resin stiffener material and a polyethylene flexible material.

21. The bodyboard of claim 16, wherein the stringer element has substantially uniform dimensions along the length of the stringer element.

22. The bodyboard of claim 16, wherein the stringer element comprises a solid cylindrical rod composed of a flexible polymeric material and fiber resin stiffener material.

23. The bodyboard of claim 16, wherein the helical spring is comprised of two or more sections joined together, each section of spring element having a different cross-section.

24. The bodyboard of claim 16, wherein the helical spring is comprised of two or more sections joined together, each section of spring element made of a different material.

25. The bodyboard of claim 16, wherein the helical spring is comprised of two sections joined together, a stiff section with a greater spring wire cross section and a front flexible section with smaller spring wire cross section disposed toward the front nose end, whereby allowing greater flexibility in the front nose end.

* * * * *